US008381420B1

(12) United States Patent
Hipple et al.

(10) Patent No.: US 8,381,420 B1
(45) Date of Patent: Feb. 26, 2013

(54) MATERIAL DISPENSER

(76) Inventors: Samuel M. Hipple, Davenport, IA (US); Matthew T. Moran, Davenport, IA (US); Aric Hamburg, Brillion, WI (US)

( * ) Notice: Subject to any disclaimer, the term of this patent is extended or adjusted under 35 U.S.C. 154(b) by 0 days.

(21) Appl. No.: 13/194,475

(22) Filed: Jul. 29, 2011

Related U.S. Application Data

(63) Continuation of application No. 12/491,916, filed on Jun. 25, 2009, now Pat. No. 8,011,120.

(60) Provisional application No. 61/133,053, filed on Jun. 25, 2008.

(51) Int. Cl.
*E01H 5/09* (2006.01)

(52) U.S. Cl. ..... 37/227; 37/230; 37/242; 37/248; 239/650

(58) Field of Classification Search ..... 37/227, 37/230, 241, 242, 244, 248–259; 239/650, 239/659, 661, 668, 681, 683, 684, 686, 687
See application file for complete search history.

(56) References Cited

U.S. PATENT DOCUMENTS

| | | | | | |
|---|---|---|---|---|---|
| 2,652,288 | A * | 9/1953 | Sands | 406/162 |
| 2,997,796 | A * | 8/1961 | Pogue et al. | 37/230 |
| 3,029,984 | A * | 4/1962 | Cooper | 222/608 |
| 3,346,973 | A * | 10/1967 | Meyer et al. | 37/227 |
| 4,032,074 | A * | 6/1977 | Amerine | 239/685 |
| 4,106,704 | A * | 8/1978 | McRoskey et al. | 239/685 |
| 4,180,184 | A * | 12/1979 | Florer et al. | 222/41 |
| 4,491,275 | A * | 1/1985 | Holsworth | 239/663 |
| 4,571,861 | A * | 2/1986 | Klever et al. | 37/241 |
| 5,515,623 | A * | 5/1996 | Weeks | 37/227 |
| 5,570,814 | A * | 11/1996 | Havlovitz | 222/45 |
| 5,706,592 | A * | 1/1998 | Sinclair, Jr. | 37/265 |
| 5,992,134 | A * | 11/1999 | Blide et al. | 56/16.8 |
| 6,138,927 | A * | 10/2000 | Spear et al. | 239/666 |
| 6,910,646 | B2 * | 6/2005 | Vernon | 239/650 |
| 6,945,481 | B2 * | 9/2005 | Thompson et al. | 239/663 |
| 7,104,478 | B2 * | 9/2006 | Niemela et al. | 239/672 |
| 7,137,214 | B2 * | 11/2006 | Hoerle et al. | 37/242 |
| 7,293,723 | B2 * | 11/2007 | Niemela et al. | 239/672 |
| 2002/0117562 | A1 * | 8/2002 | Kost | 239/666 |
| 2005/0050774 | A1 * | 3/2005 | Cadman | 37/266 |
| 2007/0056191 | A1 * | 3/2007 | Hoerle et al. | 37/227 |
| 2008/0179432 | A1 * | 7/2008 | Hodge | 239/650 |
| 2009/0282707 | A1 * | 11/2009 | Shenouda | 37/227 |

* cited by examiner

*Primary Examiner* — Matthew Buck
(74) *Attorney, Agent, or Firm* — Hamilton IP Law, PC; Jay R. Hamilton; Charles A. Damschen

(57) ABSTRACT

A material dispenser that may be used with a snow removal machine is comprised of a container, broadcaster actuator, and broadcaster in one embodiment. The material dispenser allows the operator to broadcast dry treatment material from a container mounted to the snow removal machine regardless of whether the precipitation engaging member of the snow removal machine is operating. The broadcaster actuator operates to cause the treatment material to be placed on or adjacent the path of the snow removal machine. The broadcast actuator may be positioned on a handle member of the snow removal machine so that it is convenient for the operator to engage the broadcast actuator while operating the snow removal machine or when the precipitation engaging member is not removing precipitation. A slide gate may be used to throttle the volume of treatment material exiting the container, and a slide gate actuator may be remotely mounted.

11 Claims, 11 Drawing Sheets

MATERIAL DISPENSER

CROSS REFERENCE TO RELATED APPLICATIONS

The present application is a continuation of and claims priority from U.S. patent application Ser. No. 12/491,916 filed on Jun. 25, 2009 now U.S. Pat. No. 8,011,120, which claimed priority under 35 U.S.C. §119(e) of provisional U.S. patent application Ser. No. 61/133,053 filed on Jun. 25, 2008, both of which are incorporated by reference herein in their entireties.

FIELD OF INVENTION

This invention deals with snow and ice handling equipment, and more particularly an attachment for a snow removal machine to independently apply a dry surface treatment material.

STATEMENT REGARDING FEDERALLY SPONSORED RESEARCH OR DEVELOPMENT

No federal funds were used to develop or create the invention disclosed and described in the patent application.

REFERENCE TO SEQUENCE LISTING, A TABLE, OR A COMPUTER PROGRAM LISTING COMPACT DISK APPENDIX

Not Applicable

AUTHORIZATION PURSUANT TO 37 CFR §1.71 (d)

A portion of the disclosure of this patent document contains material that is subject to copyright and trademark protection. The copyright owner has no objection to the facsimile reproduction by anyone of the patent document or the patent disclosure, as it appears in the Patent and Trademark Office patent file or records, but otherwise reserves all copyrights whatsoever.

BACKGROUND OF THE INVENTION

As is well known, after snow falls it is desirable to remove the snow from areas that are used by pedestrians and vehicles. As used herein, the term "areas" includes sidewalks and other known pedestrian walkways such as walking paths, stairs, patios and decks, as well as driveways and certain roadways, parking areas and alleyways that are cleaned after a snowstorm with a conventional shovel, snow removal machine, or other equipment that carries a plow.

In the typical operation of a snow removal machine, a scraper at the front of the housing opening lifts the snow into the housing where the precipitation engaging member or impeller cuts the snow/precipitation. However, no matter the type of conventional snow removal machine used to clear an area, after the snow removal machine passes over the area, a layer of snow, ice and/or slush will remain. This can be due to the inability of the snow removal machine to scrape all of the snow, ice, and/or slush off the surface of the area because of damage to the opening of the housing, because of an irregular/uneven surface in the area being cleared that results in the front opening of the snow removal machine riding over the highest point of the irregular/uneven surface and thereby passing over some of the snow, ice, and/or slush. In order to treat this situation, many people attempt to spread a deicer on the surface of the area using their hand or a manual spreader after they have completed using a snow removal machine. However, these spreaders may not provide enough deicer to effect a substantially complete clearing of the area. Alternatively, an excessive amount of the deicer may be applied over the area to be treated. Excessive amounts of deicer can cause significant waste of the deicer and structural damage to the surface of the area that will only add to the inability of a snow removal machine to effectively clean off that area in the future. Additionally, excessive amounts of deicer can be environmentally dangerous and cause injuries to people and animals that use the treated area. As a result, a system for properly applying a predetermined and accurate amount of a treatment material is needed.

Furthermore, the additional steps of having to separately retrieve and distribute treatment material is undesirable as it adds to the total time required to complete the snow removal and treat the area from which the snow was removed.

A need therefore exists in the art for a snow removal machine that applies a treatment material to the surface of an area after a snow removal machine has passed over that surface in order to deice the surface and prevent the formation of future ice and snow on the surface. A need also exists for such a device that eliminates the additional steps of retrieving the deicing and/or anti-icing material and applying it separately from the snow removal operation.

BRIEF DESCRIPTION OF THE FIGURES

In order that the advantages of the material dispenser will be readily understood, a more particular description of the material dispenser briefly described above will be rendered by reference to specific embodiments illustrated in the appended drawings. Understanding that these drawings depict only typical embodiments of the material dispenser and are not therefore to be considered limited of its scope, the material dispenser will be described and explained with additional specificity and detail through the use of the accompanying drawings.

DETAILED DESCRIPTION-LISTING OF ELEMENTS

Figure 1:
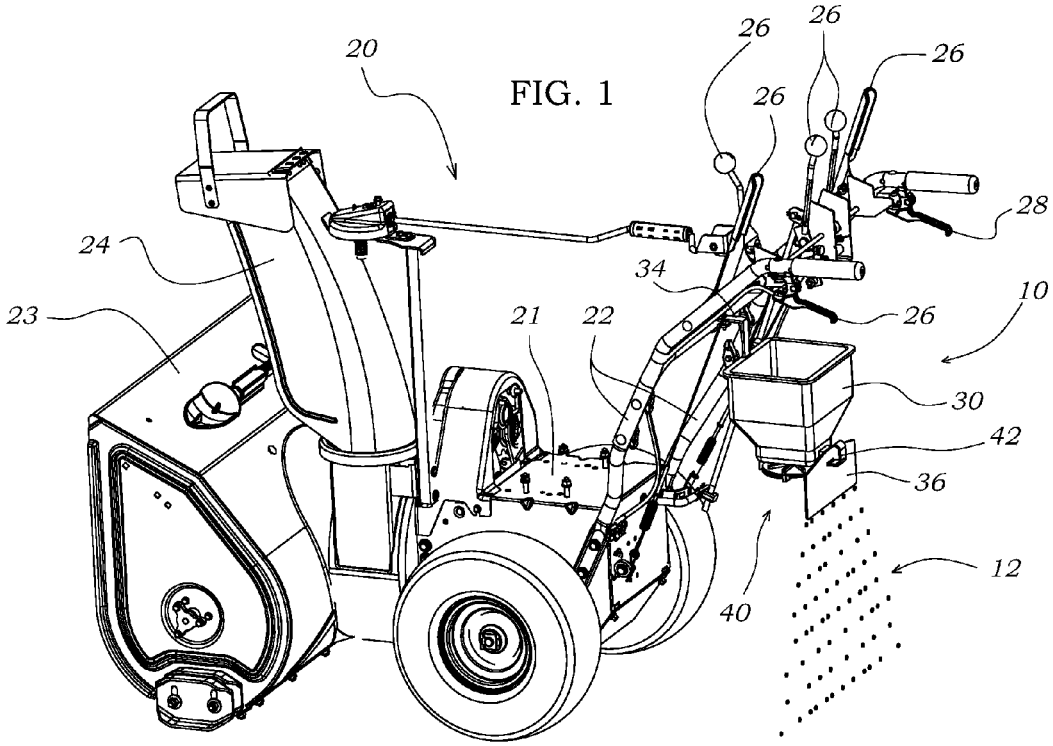
FIG. 1 is a perspective view of a first embodiment of the material dispenser attached to a walk-behind snow removal machine.

| ELEMENT DESCRIPTION | ELEMENT # |
|---|---|
| Material dispenser | 10 |
| Treatment material | 12 |
| Snow removal machine | 20 |
| Frame | 21 |
| Handle member | 22 |
| Cross member | 22a |
| Housing | 23 |
| Chute | 24 |
| Control | 26 |
| Broadcaster actuator | 28 |
| Broadcaster actuator cable | 29 |
| Cable end | 29a |
| Container | 30 |
| Material slot | 30a |
| Slide gate | 32 |
| Mounting bracket | 34 |
| Deflector | 36 |
| Broadcaster | 40 |
| Broadcaster wall | 41 |
| Slide gate control | 42 |
| Agitator | 43 |
| Return spring | 44 |
| Ratchet ring | 45 |
| Tooth | 46 |
| Actuation member | 47 |
| Attachment arm | 47a |
| Pawl | 48 |
| Pawl spring | 48a |
| Broadcaster | 50 |
| Cable attachment portion | 50a |
| Broadcaster wall | 51 |
| Slide gate control | 52 |
| Agitator | 53 |
| Return spring | 54 |
| Container | 60 |
| Shoulder | 60a |
| Container lid | 60b |
| Material slot | 61 |
| Slide gate actuator | 62 |
| Slide gate cable | 63 |
| Slide gate cable end | 63a |
| Slide gate return spring | 64 |
| Return spring anchor | 65 |
| Slide gate | 66 |
| Cable attachment | 66a |
| Material director | 68 |

Before the various embodiments of the present invention are explained in detail, it is to be understood that the invention is not limited in its application to the details of construction and the arrangements of components set forth in the following description or illustrated in the drawings. The invention is capable of other embodiments and of being practiced or of being carried out in various ways. Also, it is to be understood that phraseology and terminology used herein with reference to device or element orientation (such as, for example, terms like "front", "back", "up", "down", "top", "bottom", and the like) are only used to simplify description of the present invention and do not alone indicate or imply that the device or element referred to must have a particular orientation. In addition, terms such as "first", "second", and "third" are used herein and in the appended claims for purposes of description and are not intended to indicate or imply relative importance or significance.

DETAILED DESCRIPTION

Referring now to the drawings, wherein like reference numerals designate identical or corresponding parts throughout the several views, FIG. 1 illustrates a snow removal machine 20, which may be found in the prior art, incorporating a first embodiment of the material dispenser 10. As is well known to those skilled in the art, snow removal machines 20 of the type pictured herein generally include a motor (not shown), a plurality of wheels (not identified), a housing 23, an opening (not shown) at the front of the housing 23, at least one precipitation engagement member (not shown) positioned within the housing 23, a chute 24 adjacent the housing 23, a frame 21, and at least one handle member 22. A cross member 22*a* may be positioned between two handle members 22 for added strength, as in the embodiment shown in FIG. 1. A plurality of controls 26 may be positioned on or adjacent the handle members 22 to allow the operator to control the snow removal machine 20 from a second position.

Prior art snow removal machines 20 are described more fully in U.S. Pat. Nos. 7,137,214; 6,508,018; 6,499,237; and 5,479,730, all of which are incorporated by reference herein in their entireties. Even though the embodiments of the material dispenser 10 disclosed and claimed herein are more generally applicable to motorized snow removal machines 20, that in no way limits the scope of the material dispenser 10. The material dispenser 10 may be used in conjunction with snow removal machines 20 other than those depicted in the figures. For example, the material dispenser 10 may be used with a snow removal machine 20 that is not self-propelled, wherein the operator is required to exert force to move the snow removal machine 20 along a desired path. The material dispenser 10 may also be used with self-propelled snow removal machines 20, such as those shown in FIGS. 1 and 2. The snow removal machine 20 shown in FIGS. 1 and 2 is driven in a substantially linear direction by powered rotation of the wheels thereof, which wheels are operably engaged with a motor (not shown) by structures well known to those skilled in the art.

In the embodiments pictured herein, the material dispenser 10 is attached to the cross member 22*a* of the snow removal machine 20. In other embodiments not pictured herein, the material dispenser 10 may be attached to other portions of the snow removal machine 20, such as the housing 23, one or both handle members 22, or the frame 21. The specific structure of the snow removal machine 20 to which the material dispenser 10 is attached in no way limits the scope of the material dispenser 10, as long as the material dispenser 10 is positioned between the opening in the housing 23 and the operator, and does not interfere with the other working mechanical components of the snow removal machine 20. Furthermore, certain elements of the material dispenser 10 may be mounted remotely from other elements thereof, and variations to the embodiments shown herein with naturally occur to those skilled in the art without departing from the spirit and scope of the material dispenser 10.

Figure 2:
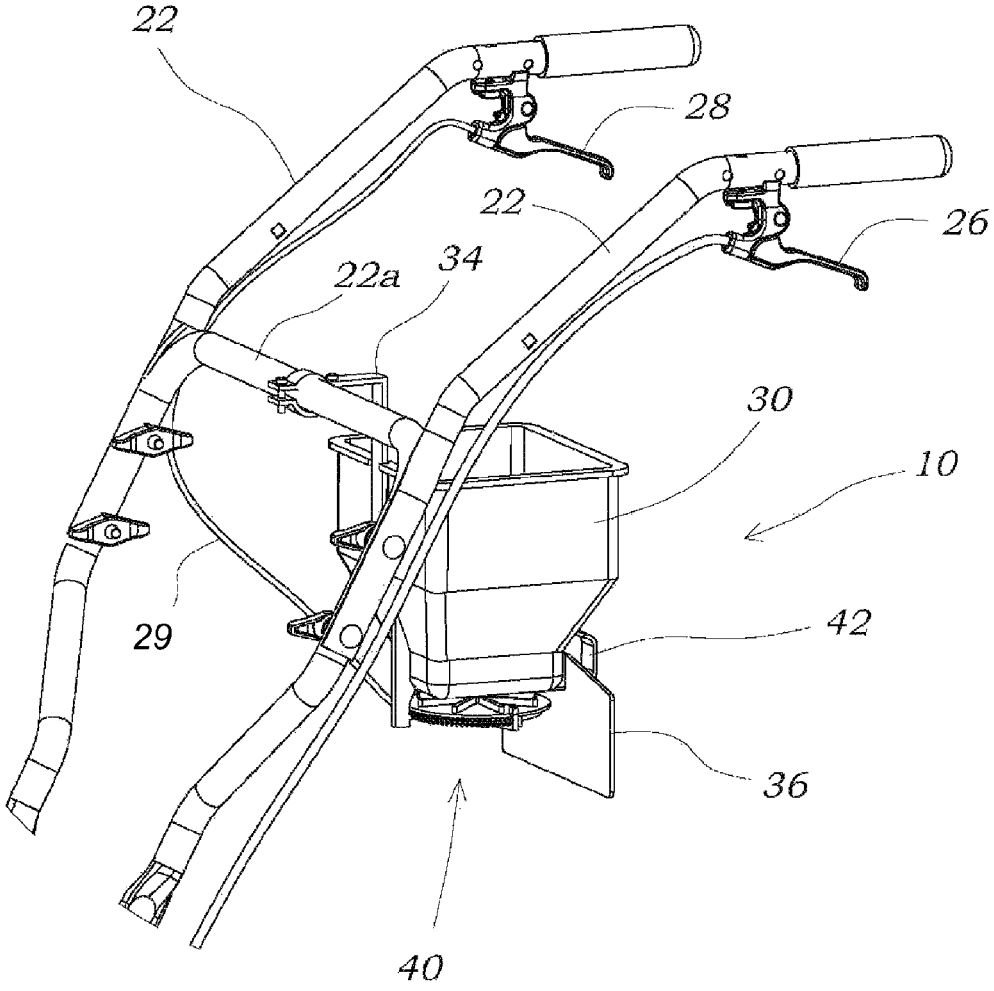
FIG. 2 is a detailed view of the first embodiment the material dispenser wherein certain components of the snow removal machine have been removed for clarity.

A more detailed view of the first embodiment of the material dispenser 10 is shown in FIG. 2, which provides a perspective view of the first embodiment attached to the cross member 22*a*, which cross member 22*a* is positioned between two handle members 22. In the first embodiment, a mounting bracket 34 is used to attach the material dispenser to the cross member 22*a* by way of a simple clamping mechanism, although any attachment structure and/or method known to those skilled in the art that is suitable for the specific embodiment of the material dispenser 10 may be used without departing from the spirit and scope of the material dispenser 10.

A container 30, which holds the treatment material 12 to be dispensed on the surface on which the snow removal machine 10 is operated, is affixed to the mounting bracket in the first embodiment. One possible pattern of treatment material 12 as applied by the material dispenser 10 is shown in FIG. 1. In the embodiments shown herein, the material dispenser 10 is primarily mounted to the snow removal machine 20 by attaching the mounting bracket 34 to the cross member 22*a* by a clamp formed in the mounting bracket 34. However, any suitable structure and/or mounting method known to those skilled in the art, such as bolts, screws, clamps, and the like may be used alone or in conjunction. In other embodiments not pictured herein, certain elements of the material dispenser 10 may be integrally formed with the snow removal machine 20.

In the embodiments pictured herein, the container 30 is shaped similar to a hopper having sloping sides, wherein treatment material 12 settles by force of gravity to the bottom of the container 30. Near the bottom of the container 30 is a material slot 30*a* (best shown for the first and second embodiments in FIG. 5) through which treatment material 12 may exit the container 30, depending on the position of the slide gate 32, which is described in detail below. The slide gate 32 in both the first and second embodiments is slideable with respect to the container 30, such that the operator may easily position of the slide gate 32 in the proper position with respect to the material slot 30*a*.

When the slide gate 32 is not placed over the material slot 30*a*, treatment material 12 may pass from the interior of the container 30 through the material slot 30*a* out of the container 30 and onto the broadcaster 40. When the slide gate 32 is placed over the material slot 30*a*, the slide gate 32 blocks treatment material 12 from exiting the interior of the container 30 through the material slot 30*a*. The slide gate 32 may be used to partially block a portion of the material slot 30*a* and thereby throttle the amount of treatment material 12 that exits the container 30 through the material slot 30*a*. The container 30 may be shaped in any manner that facilitates delivery of the treatment material 12 to the material slot 30*a*, and the shapes of containers 30 shown herein are for illustrative purposes only. In the first and second embodiments, a channel (not shown) is formed in the bottom side of the container 30 into which a portion of the slide gate 32 fits in cooperative engagement, such that the slide gate 32 is moveable with respect to the container 30 in only one dimension. However, any structure and/or method that allow the operator to control the amount of treatment material 12 that exits the container 30 through the material slot 30*a* may be used with the material dispenser 10 without departing from the spirit and scope thereof, and variations from the embodiments shown and disclosed herein will occur to those skilled in the art.

As mentioned, the amount of treatment material 12 allowed to pass through the material slot 30*a* may be regulated via the slide gate 32, which serves to restrict the area of the material slot 32 available through which treatment material 12 may flow. In the embodiments pictured herein, the slide gate 32 is mounted to the bottom exterior surface of the container 30 and is simply a movable plate that restricts the open area of the material slot 32. The position of the slide gate 32 in the first and second embodiments (FIGS. 1-5) is controlled via the slide gate control 42, 52, respectively, which is in direct mechanical communication with the slide gate 32 and controls the position thereof. In other embodiments not shown, the slide gate 32 and slide gate control 42, 52 may be oriented in a different position with respect to the container 30, as is obvious to those skilled in the art. For example, the slide gate 32 and slide gate control 42, 52 may be mounted vertically to the front exterior side of the container 30, or any other part of the snow removal machine 20 or material dispenser 10 so long as the slide gate 32 serves to control the amount of treatment material 12 delivered to the broadcaster 40, 50 from the interior of the container 30. The slide gate control for the third embodiment of the material dispenser 10 is mounted remotely from the container 30, which is described in detail below.

Figure 3A:
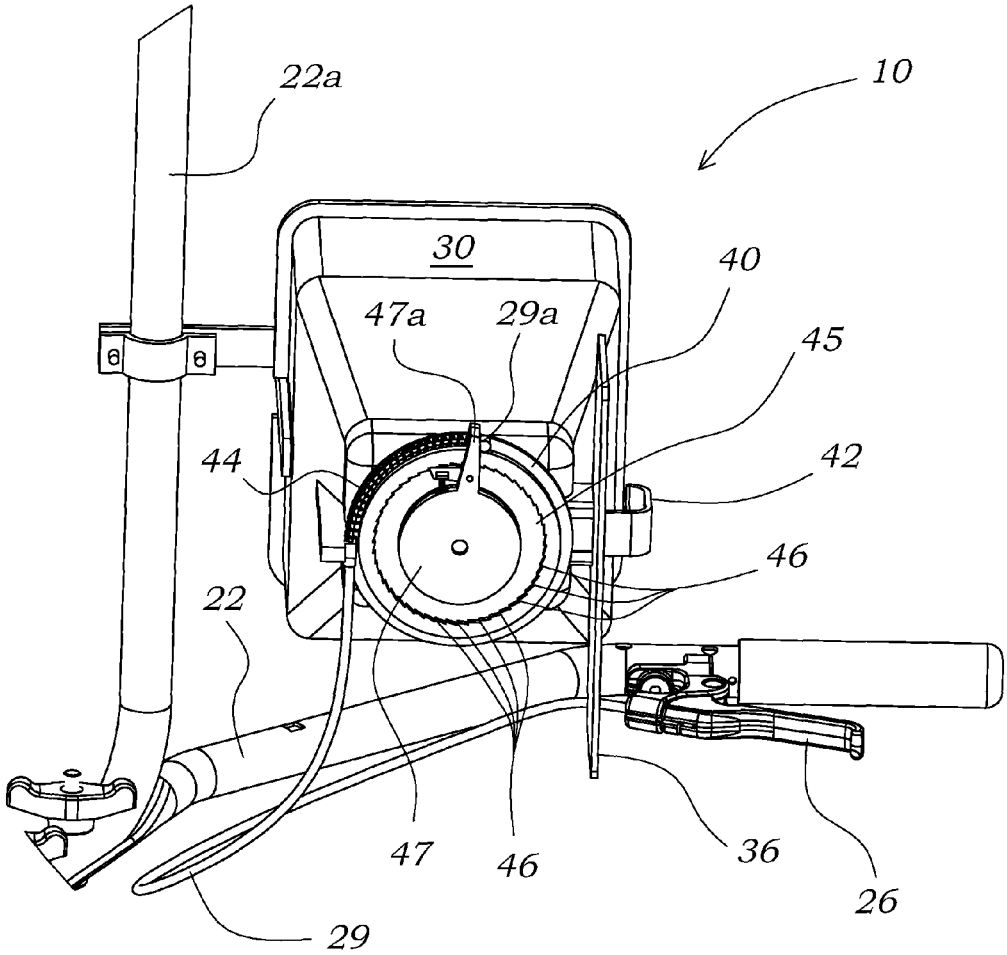
FIG. 3A is a bottom view of the first embodiment of the material dispenser attached to a walk-behind snow removal machine.
Figure 3B:
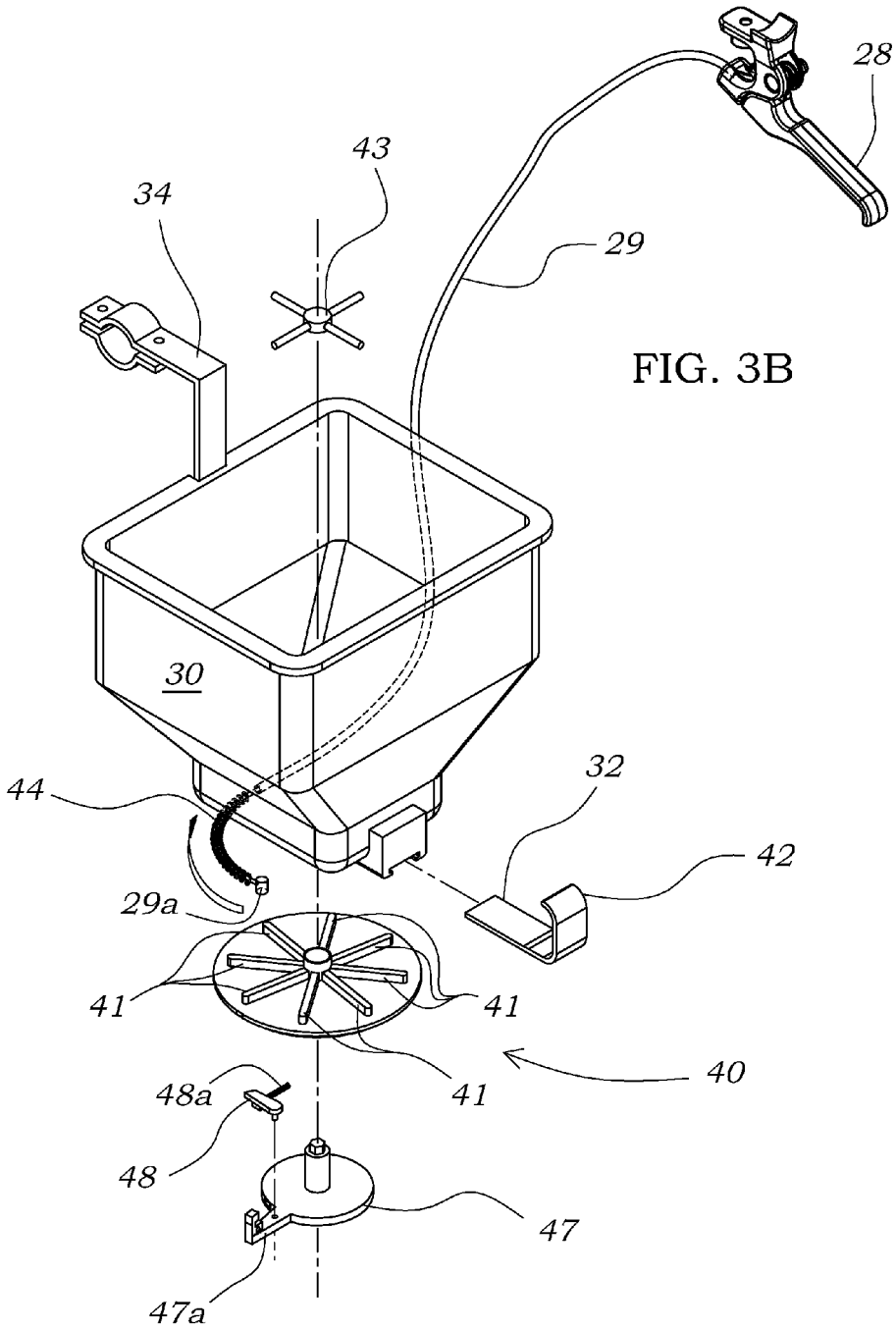
FIG. 3B is an exploded view of the first embodiment of the material dispenser and broadcaster portion thereof.
Figure 3C:
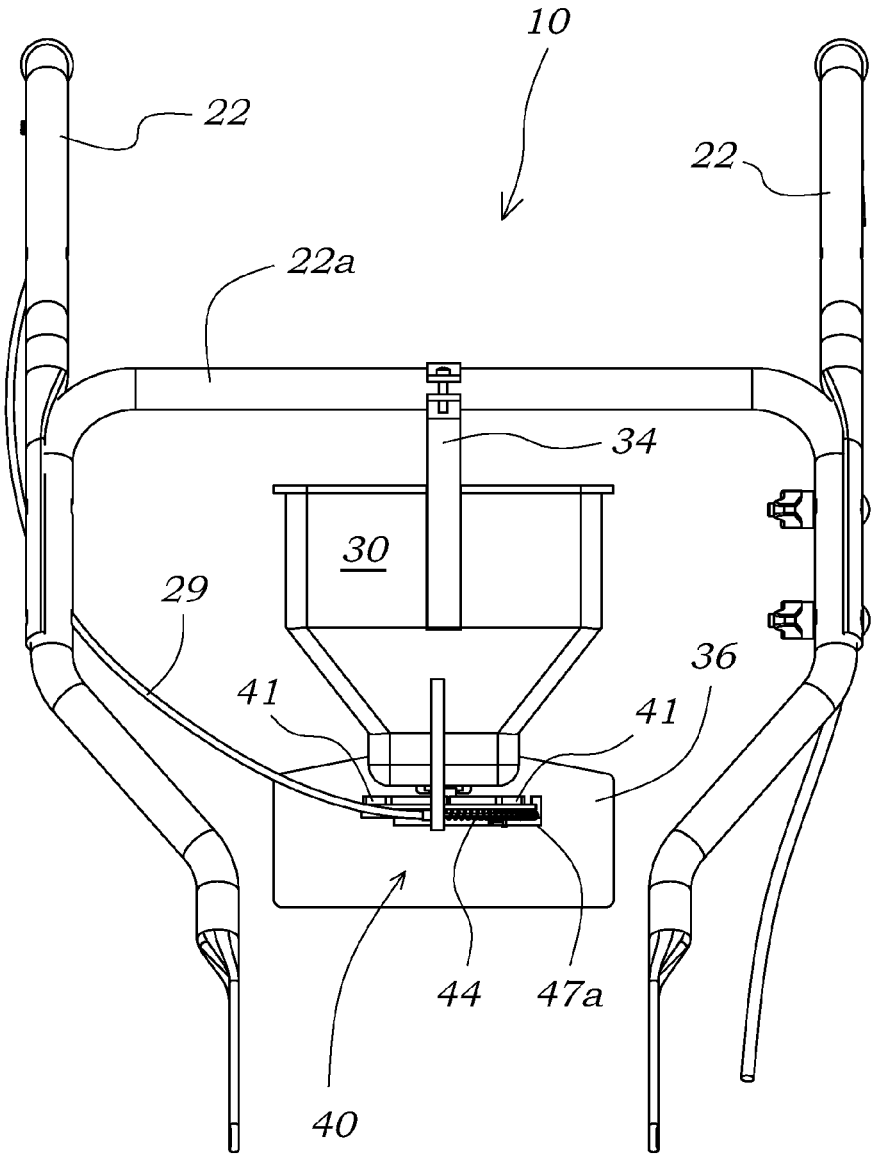
FIG. 3C is a detailed front view of the first embodiment of the material dispenser attached to a walk-behind snow removal machine.
Figure 4A:
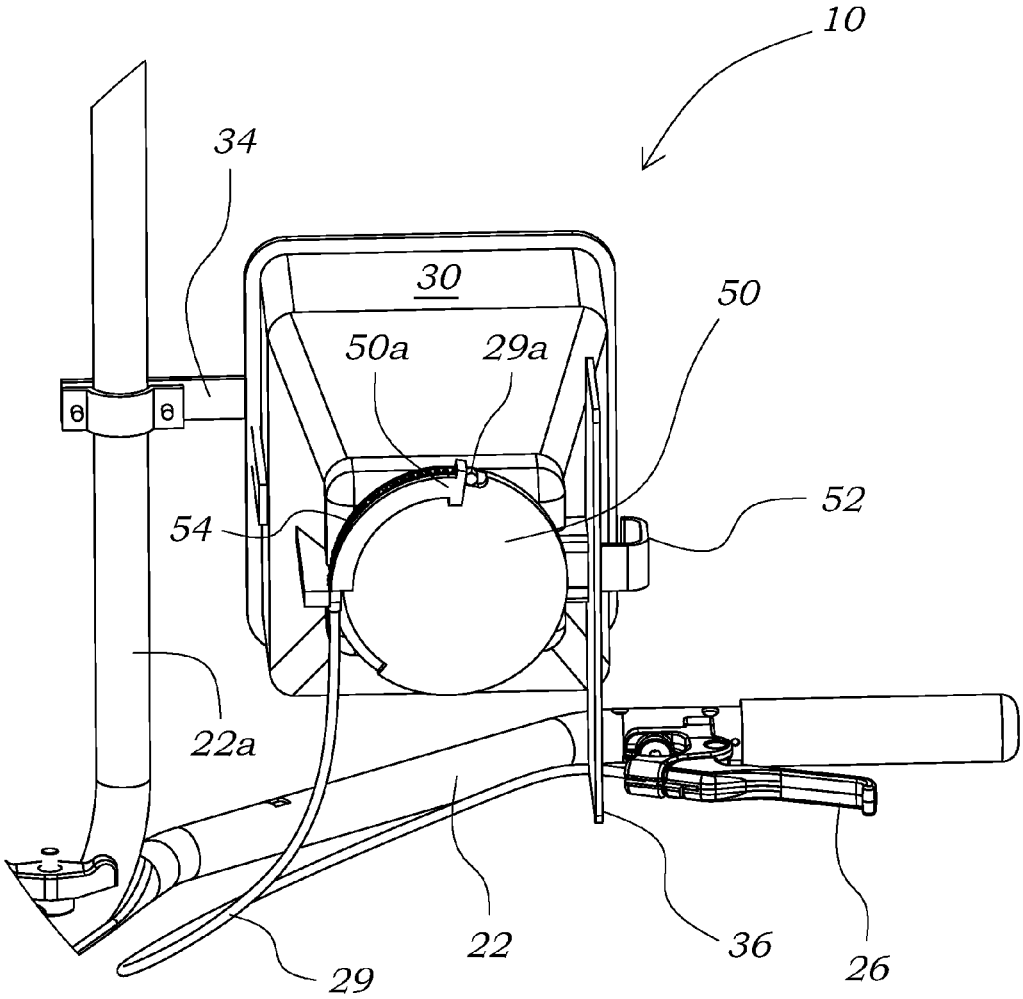
FIG. 4A is a bottom view of a second embodiment of the material dispenser attached to a walk-behind snow removal machine.
Figure 4B:
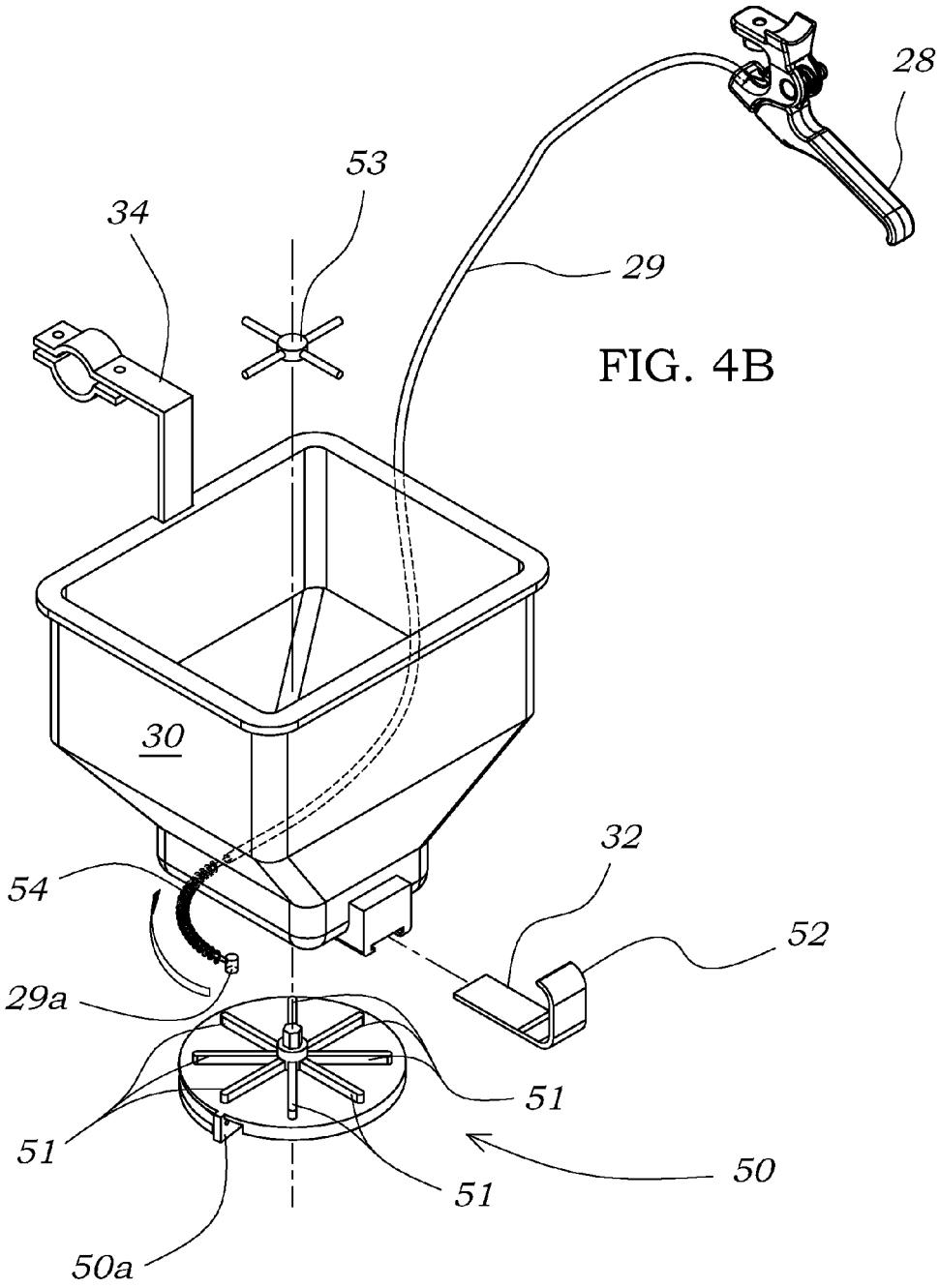
FIG. 4B is an exploded view of the second embodiment of the material dispenser and broadcaster portion thereof.
Figure 4C:
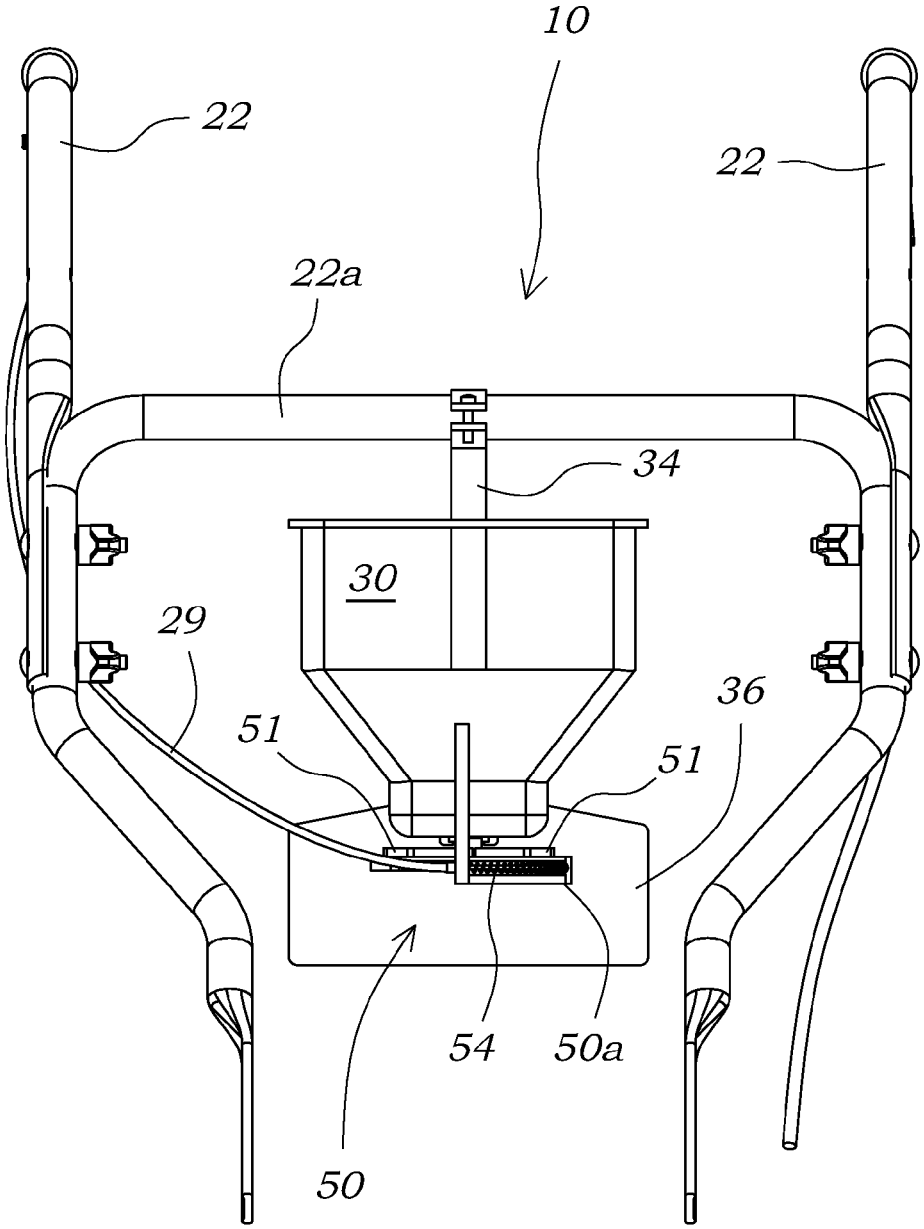
FIG. 4C is a detailed front view of the second embodiment of the material dispenser attached to a walk-behind snow removal machine.

In the first embodiment of the material dispenser 10, which is shown in FIGS. 1-3C, the broadcaster 40 is a generally wheel-shaped structure with a plurality of broadcaster walls 41 formed therein on the top surface of the broadcaster 40 (FIG. 3B). In the second embodiment of the material dispenser, which is shown in FIGS. 4A-4C, the top surface of the broadcaster 50 is very similar to the broadcaster 40 in the first embodiment, wherein a plurality of broadcaster walls 51 are positioned on the top side of the broadcaster 50 (FIG. 4B). In both the first and second embodiments, the broadcaster 40, 50 is oriented such that the radial dimension thereof is positioned in a substantially horizontal plane. Furthermore, in both the first and second embodiments, the broadcaster 40, 50 is pivotally mounted to the exterior of the container 30 adjacent the material slot 32.

Figure 5:
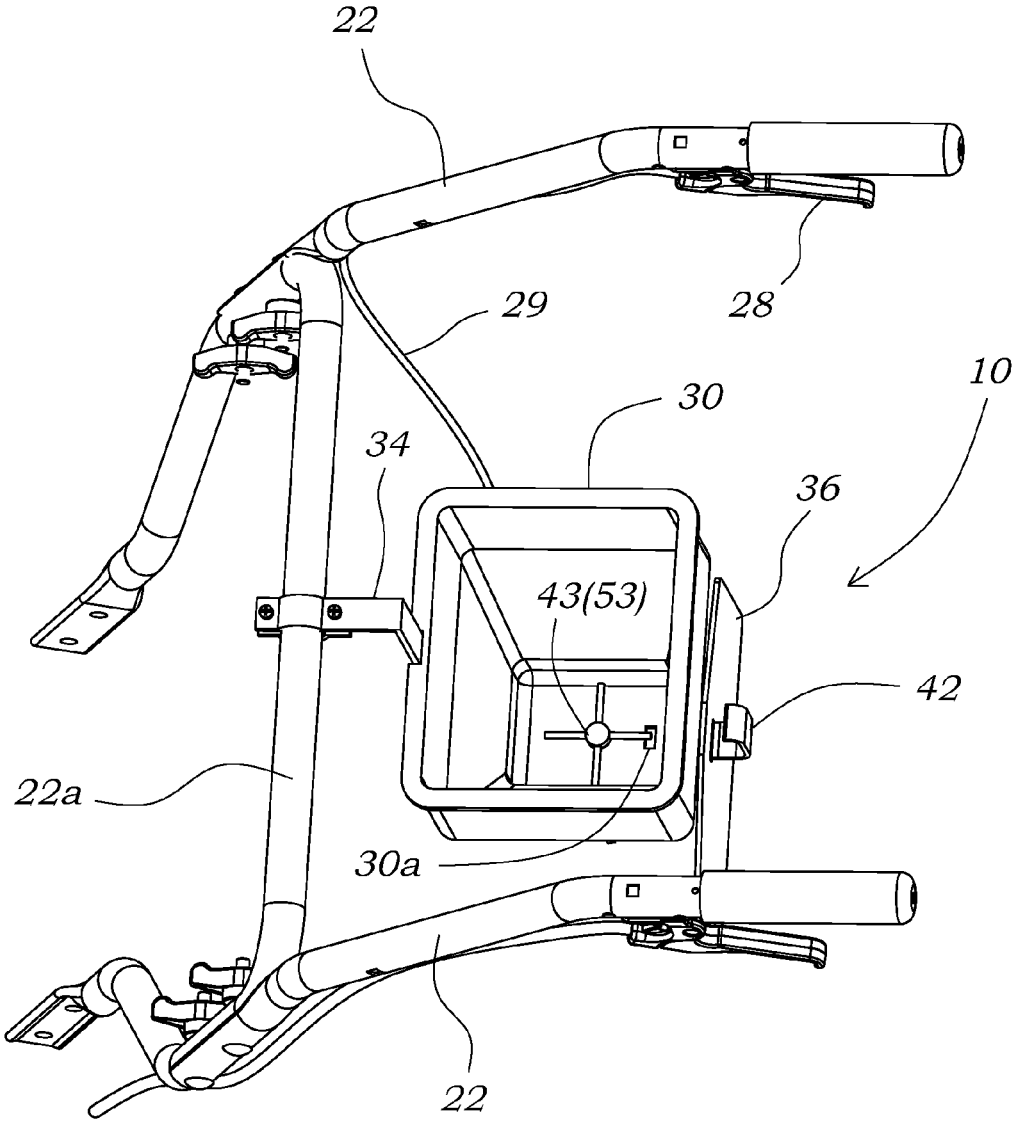
FIG. 5 is a top perspective view of a third embodiment of the material dispenser that may be attached to a walk-behind snow removal machine.

In both the first and second embodiments of the material dispenser 10, an agitator 43 may be positioned adjacent the material slot 30*a* on the interior of the container 30. A top view of either the first or second embodiment of the material dispenser 10 is shown in FIG. 5, in which figure the agitator 43, 53 is best shown. In either the first or second embodiment, the agitator 43, 53 may be fixedly mounted to the broadcaster 40, 50 such that as the broadcaster 40, 50 rotates, the agitator 43, 53 also rotates. Furthermore, if the agitator 43, 53 is so fixedly mounted, the agitator will rotate at the same rate and by the same amount and rate of the broadcaster 40, 50. The agitator 43, 53 serves to mix the treatment material 12 in the container 30 when the broadcaster 40, 50 is rotating so that a constant amount of treatment material 12 passes through the material slot 30*a* and the likelihood of plugging is reduced.

In the first embodiment of the material dispenser, the broadcaster 40 is formed with a concave ratchet ring 45 recessed into the bottom surface thereof, which is best shown in FIG. 3A, which provides a bottom view of the material dispenser 10. The ratchet ring 45 is comprised of a plurality of teeth 46 positioned along the periphery thereof. Positioned within the recess on the bottom side of the broadcaster is an actuation member 47. The actuation member 47 is generally circular in shape with an attachment arm 47*a* protruding therefrom. The actuation member 47 in the first embodiment is pivotally mounted to the container 30 and pivotal with respect thereto about the same axis of rotation as the broadcaster 40. However, the actuation member 47 is also pivotal with respect to the broadcaster in a certain direction of rotation, which is determined by the orientation of the ratchet ring 45 and pawl 48 and is described in detail below. Pivotally affixed to the attachment arm 47*a* is a pawl 48, which is configured to operably engage any one tooth 46 of the ratchet ring 45 at a given time. A pawl spring 48*a* is affixed to the pawl 48 and functions to bias the pawl 48 radially outward toward the ratchet ring 45, which the pawl spring 48*a* accomplishes by engaging the outer periphery of the actuation member 47.

The attachment arm 47*a* extends beyond the periphery of the broadcaster and includes an elevated portion that engages the broadcaster actuator cable 29 at the cable end 29*a*. The opposite end of the broadcaster actuator cable 29 is affixed to the broadcaster actuator 28, which in both the first and second embodiments is affixed to the right side handle member 22. In both the first and second embodiments, the operator causes the broadcaster 40, 50 to rotate by moving the broadcaster actuator 28 from the position shown in FIG. 1 to a position wherein the broadcaster actuator 28 is substantially parallel to the handle member 22, which may be accomplished through a squeezing motion. As the distal end of the broadcaster actuator 28 is moved towards the handle member 22 (which causes the broadcaster actuator 28 to become oriented in a more parallel position with respect to the handle member 22), the broadcaster actuator cable 29 is translated and moved in a direction towards the broadcaster actuator 28.

In the first embodiment, moving the broadcaster actuator 28 to an orientation more parallel to the handle member 22 causes the actuation member 47 to rotate in a counterclockwise direction when viewed from the vantage shown in FIG. 3A. A return spring 44 is positioned between a portion of the container 30 and the attachment arm 47*a* to bias the actuation member 47 in a clockwise direction when viewed from the vantage shown in FIG. 3A. Accordingly, when the broadcaster actuator 28 is moved to be parallel the handle member 22, the operator must overcome the biasing force of the return spring 44, thereby compressing the return spring 44 between the container 30 and attachment arm 47*a*. The return spring 44 is sized such that when the operator releases the broadcaster actuator 28, the return spring 44 extends and causes the actuation member 47 to rotate clockwise.

As is clear from FIG. 3A, when the actuation member 47 rotates in a clockwise direction from the vantage shown in FIG. 3A, the pawl 48 slips across individual teeth 46 of the ratchet ring 45 such that the actuation member 47 may rotate in the clockwise direction independently of the broadcaster 40. However, when the actuation member 47 rotates in the counterclockwise direction (i.e., when the operator squeezes the broadcaster actuator 28), the pawl 48 engages one individual tooth 46 of the ratchet ring 45 due to the radially outward biasing force of the pawl spring 48*a*, thereby causing the broadcaster 40 to rotate by the same degree and at the same rate as the degree and rate that the actuation member 47 rotates. Accordingly, the broadcaster 40, ratchet ring 45, teeth 46, actuation member 47, pawl 48, and pawl spring 48*a* operate as a ratcheting mechanism, and in the first embodiment cooperate to allow the broadcaster 40 to rotate in only one direction (i.e., counterclockwise from the vantage of FIG. 3A). In light of the present disclosure, variations of the ratcheting mechanism of the first embodiment as disclosed herein will become apparent to those of ordinary skill in the art. Accordingly, other embodiments of the broadcaster actuator 28, broadcaster 40, return spring 44, ratchet ring 45, teeth 46, actuation member 47, pawl 48, and pawl spring 48*a* may be used without departing from the spirit and scope of the material dispenser 10, including any suitable ratcheting mechanism occurring to those skilled in the art.

In the second embodiment of the material dispenser 10, generally shown in FIGS. 4A-4C and 5, the broadcaster 50 is not formed with a ratchet ring 45. Instead, the broadcaster 50 includes a cable attachment portion 50*a* on the bottom side thereof, which is best shown in FIG. 4A. The cable attachment portion 50*a* retains a return spring 54 therein that is positioned around a portion of the periphery of the broadcaster actuator cable 29 that is adjacent the cable end 29*a*. The cable end 29*a* is retained in the cable attachment portion 50*a*.

In the second embodiment, moving the broadcaster actuator 28 to an orientation more parallel to the handle member 22 (i.e., squeezing the broadcaster actuator 28) causes the broadcaster 50 to rotate in a counterclockwise direction when viewed from the vantage shown in FIG. 4A. The return spring 54 is positioned between a portion of the container 30 and the cable attachment portion 50*a* to bias the broadcaster 50 in a clockwise direction when viewed from the vantage shown in FIG. 4A. Accordingly, when the broadcaster actuator 28 is moved to be parallel the handle member 22, the operator must overcome the biasing force of the return spring 54, thereby compressing the return spring 54 between the container 30 and cable attachment portion 50*a*. The return spring 54 is sized such that when the operator releases the broadcaster actuator 28, the return spring 54 extends and causes the broadcaster 50 to rotate clockwise. Accordingly, unlike the first embodiment in which the broadcaster 40 only rotates in one direction but the actuation member 47 rotates in two directions, in the second embodiment the broadcaster 50 may rotate in either the clockwise or counterclockwise direction. That is, the operator causes the broadcaster 50 to rotate in the counterclockwise direction (as viewed from the vantage shown in FIG. 4A), and the return spring 54 causes the broadcaster 50 to rotate in the clockwise direction (as viewed from the same vantage).

In light of the preceding detailed description, it will now be apparent to those skilled in the art that the broadcaster 50, cable attachment portion 50*a*, and return spring 54 operate as a bidirectional actuating mechanism, and in the second embodiment cooperate to allow the broadcaster 50 to rotate in only two directions. Therefore, in light of the present disclosure variations to the bidirectional actuating mechanism of the second embodiment as disclosed herein will become apparent to those of ordinary skill in the art. Accordingly, other embodiments of the broadcaster actuator 28, broadcaster 50, cable attachment portion 50*a*, and return spring 54 may be used without departing from the spirit and scope of the material dispenser 10, including any suitable bidirectional actuating mechanism occurring to those skilled in the art.

In both the first and second embodiments, as the agitator 43, 53 turns (which in those embodiments is caused by the operator squeezing and subsequently releasing the broadcaster actuator 28), gravity causes treatment material 12 to flow from the container 30 through the material slot 30*a* and onto the broadcaster 40, 50. The rotation of the broadcaster 40, 50 imparts centrifugal energy to treatment material 12 located on the broadcaster 40, 50 so that the treatment material 12 is flung from the broadcaster 40, 50 in a generally radial direction.

Generally, the more rapidly the operator squeezes the broadcaster actuator 28 in either the first or second embodiment, the more rapidly the broadcaster 40, 50 rotates, at least in the counterclockwise direction when viewed from the bottom of the container 30. Thus, more centrifugal energy is imparted to treatment material 12 that is positioned on the broadcaster 40, 50 and the treatment material 12 is flung further from the material dispenser 10 so as to cover a broader area. Consequently, the operator may adjust the distance the material dispenser 10 spreads treatment material 12 by changing the rate at which the operator squeezes the broadcaster actuator 28. Furthermore, in both the first and second embodiments, the position of the slide gate control 42, 52 determines the position of the slide gate 32, which dictates the area of the material slot 30*a* through which treatment material 12 may flow, such that the operator may control the volume of treatment material 12 delivered by the material dispenser 10.

In either the first or second embodiments, it may be desirable to position a deflector 36 between the container 30 and the operator area, which is shown in FIGS. 1-5. The deflector 36 may be mounted in any convenient location or on any portion of the snow removal machine 20 and/or material dispenser 10 that allows the deflector 36 to direct the treatment material 12 to the desired location and/or protect the operator from treatment material 12. In the first and second embodiments the deflector 36 is affixed to the container 30. In the first and second embodiments, the deflector 36 is shaped as a flat plate, but may have other shapes and/or configurations in other embodiments not shown herein. For example, in one embodiment not pictured herein, the deflector is curved inward in the direction of the snow removal machine 20 to further direct treatment material 12 away from the operator. The deflector 36 may be constructed of any material known to those skilled in the art that is suitable for the application of the snow removal machine 20 and the treatment material 12 employed. For example, the deflector 36 may be made of a metallic material, wood, polymers, etc., and/or combinations thereof.

As shown in FIGS. 1 and 2, the broadcaster actuator 28 may be easily operated without interfering with the position of the other controls 26 of the snow removal machine 20. Furthermore, the control 26 positioned on the handle member 22 opposite the handle member 22 on which the broadcaster actuator 28 is positioned easily may be operated simultaneously with the broadcaster actuator 28. This allows the operator the maximum amount of flexibility for dispensing treatment material 12. The operator may engage the broadcaster actuator 28 when the motor (not shown) is running or stopped, or when the precipitation engaging member (not shown) is moving or stationary.

In operation, the operator would fill the container 30 with treatment material 12 prior to operating the snow removal machine 20. The operator may then either engage the broadcast actuator 28 and broadcast treatment material 12 over a desired area, or the operator may start the motor (not shown) and begin removing precipitation from a surface with the snow removal machine 20 while simultaneously broadcasting treatment material 12 and removing precipitation from a surface.

Figure 6:
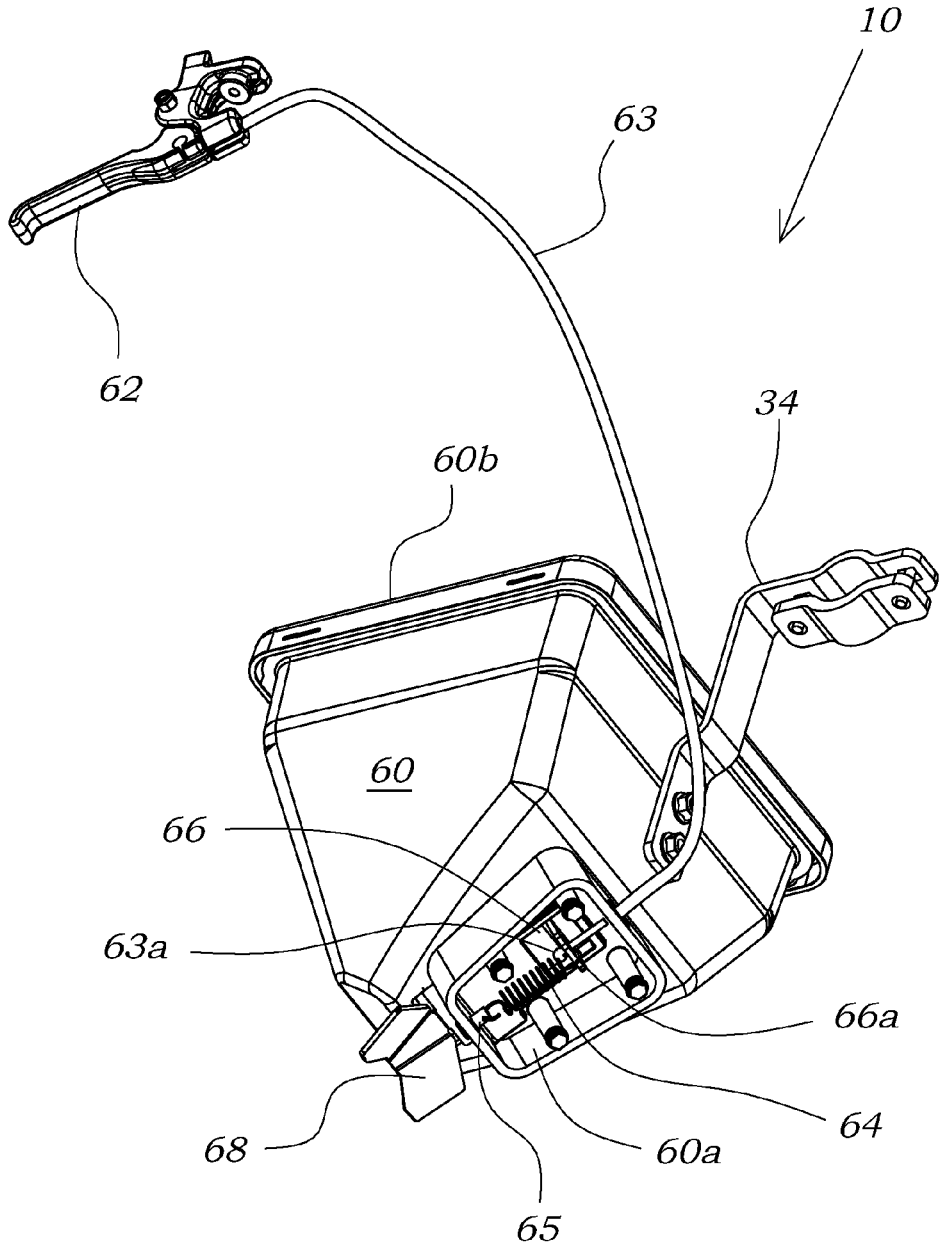
FIG. 6 is a bottom view of a third embodiment of the material dispenser that may be attached to a walk-behind snow removal machine.
Figure 7A:
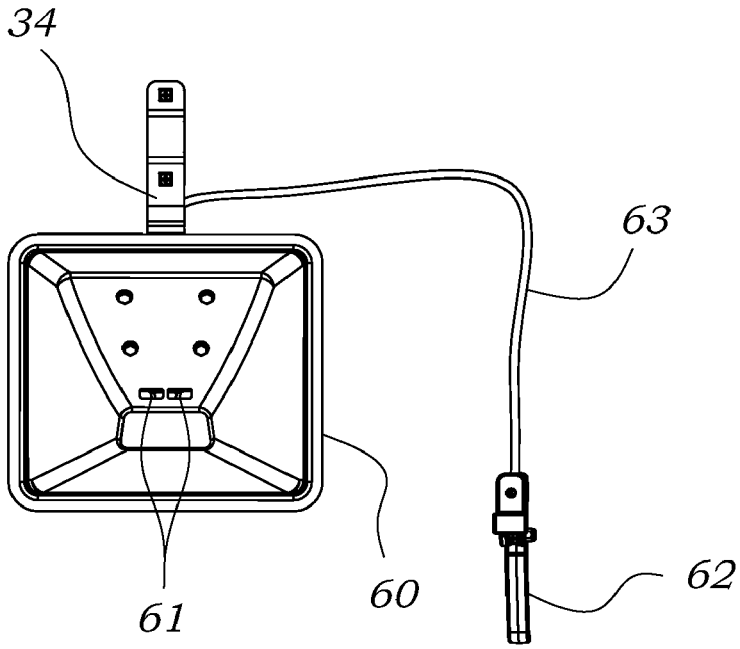
FIG. 7A is a top view of the third embodiment of the material dispenser that may be attached to a walk-behind snow removal machine.
Figure 7B:
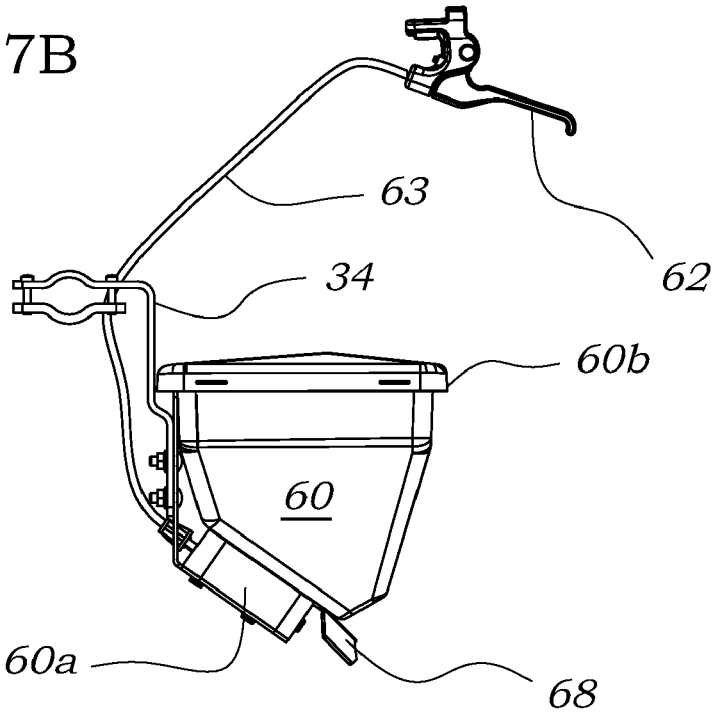
FIG. 7B is a side view of the third embodiment of the material dispenser that may be attached to a walk-behind snow removal machine.

In a third embodiment of the material dispenser 10 shown in FIGS. 6-7B, the material dispenser 10 does not include a broadcaster. The third embodiment of the material dispenser 10 is shown from a bottom perspective in FIG. 6. The container 60 for the third embodiment is shown with a container lid 60*b* positioned over the top periphery thereof in FIG. 6, which container lid 60*b* prevents foreign material, such as moisture, from entering the interior of the container 60 from above. As with the first and second embodiments, the third embodiment may be mounted to the snow removal machine with a mounting bracket 34, which is shown configured for attachment to a cross member 22*a*. However, as with the first and second embodiments, the scope of the third embodiment is not limited by the type of mounted bracket 34, mounting structure, or mounting location used therewith.

The third embodiment of the material dispenser 10 is shown from the top in FIG. 7A with the container lid 60*b* removed. The container 60 is formed with at least one material slot 61 therein adjacent the bottom of the container 60, which is shown in FIG. 7A. The third embodiment as pictured herein includes two material slots 61, which are generally symmetrically oriented with respect to one another about a centerline positioned between the two handle members 22. As shown in FIG. 6, a shoulder 60*a* is formed on a portion of the bottom surface of the container 60 in the third embodiment. The slide gate actuator 62 for the third embodiment is positioned on a handle member 22, but may be mounted elsewhere, as was disclosed for the various mounting structures and methods for the broadcaster actuator 28 in the first and second embodiments.

As with the first and second embodiments, in the third embodiment the slide gate 66 is engaged with a bottom portion of the container 60 such that the slide gate may move in one dimension with respect to the container 60. As with the other embodiments shown herein, in the third embodiment the slide gate 66 is operably engaged with a channel (not shown) that is formed in a bottom portion of the container 66 adjacent the material slots 61. However, any structure and/or method that allow the operator to control the amount of treatment material 12 that exits the container 60 through the material slots 61 may be used with the material dispenser 10 without departing from the spirit and scope thereof, and variations will naturally occur to those skilled in the art. The slide gate 66 in the third embodiment is oriented with respect to the container 60 such that the slide gate 66 may be positioned to block the material slots 61, and thereby prevent material from ingress and/or egress to and/or from the interior of the container 60 by way of the material slots 61. As with the slide gate 32 in the first and second embodiments, the slide gate 66 in the third embodiment allows the operator to throttle the volume of treatment material 12 that exits the container 60 through the material slots 61.

The slide gate 66 in the third embodiment includes a cable attachment 66*a*, which is oriented generally perpendicular to the portion of the slide gate 66 engaged with the container 60. The cable attachment 66*a* is affixed to the slide gate cable end 63*a*, which is positioned on one end of a slide gate cable 63. The opposite end of the slide gate cable 63 is engaged with a slide gate actuator 62 in much the same manner in which the broadcaster actuator cable 29 of the first and second embodiments is engaged with the broadcaster actuator 28.

A slide gate return spring 64 is positioned within the shoulder 60*a*, which is best shown in FIG. 6, on an interior portion of the shoulder adjacent the material slots 61. A first end of the slide gate return spring 64 is affixed to a return spring anchor 65 positioned on the shoulder 60*a*, and a second end of the slide gate return spring 64 is affixed to the cable attachment 66*a*. Accordingly, as the operator squeezes the slide gate actuator 62 to cause the slide gate actuator 62 to become oriented more perpendicularly to the handle member 22 on which it is mounted, the slide gate cable 63 is translated, which causes the slide gate 66 to move away from the material slots 61, thereby compressing the slide gate return spring 64 and making a larger area of the material slots 61 available for treatment material 12 to pass through when exiting the container 60. When the operator releases the slide gate actuator 62, the slide gate return spring 64 causes the slide gate 66 to return to the position shown in FIG. 6, in which position the slide gate 66 fully blocks the material slots 61 such that no treatment material 12 may exit the container 30 there through. The operator may adjust the volume of treatment material 12 applied by the material dispenser 10 by positioning the distal end of the slide gate actuator 62 nearer or further from the handle member 20 to which it is attached.

A material director 68 may be positioned on the exterior of the container 60 adjacent the material slots 61, as shown in FIG. 6. The material director 68 serves to direct treatment material 12 in the desired pattern, and may have a different angle, configuration, and/or orientation than that shown in FIG. 6. The optimal design of the material director 68 will vary from one embodiment of the material dispenser 10 to the next depending on the specific application of the material dispenser 10, the operating conditions of the snow removal machine 20, the operator preferences, and the type of treatment material 12 used.

In the third embodiment, no agitator is used. Instead, kinetic energy in the form of vibrations that are transferred from the snow removal machine 20 to the container 60 provides agitation and/or a motive force for gravitational settling of the treatment material 12. Those vibrations cause the treatment material 12 to settle within the container 60 and allow gravity to cause the treatment material 12 to exit the container 60 if the slide gate 66 is so positioned. Accordingly, the amount of vibrations transferred from the snow removal machine 20 to the container 30 may also affect the optimal area of the material slots 61.

In another embodiment for the material dispenser 10 not pictured herein the container 30 adapted for use with liquid treatment material 12. In this embodiment, the container 30 is fashioned as a tank. The container 30 is in fluid communication with the broadcaster (not shown for this embodiment) via fluid conduit. In this embodiment, the broadcaster is a type of fluid pump, which is activated via the broadcaster actuator 28. The pump used for the broadcaster may be as simple as a common fluid pump used in many containers of commercially available fluids, or the pump may be a pressure pump that pressurizes the container to force the treatment material therefrom. Downstream from the broadcaster are a plurality of nozzles through which the liquid treatment material 12 is delivered to the surface to be treated.

In still another embodiment not pictured herein, the broadcaster 40, 50 may be powered by a motor (not shown) separate from the motor (not shown) that powers the precipitation engaging member. The separate motor may be used with the first or second embodiments, or an embodiment configured for liquid treatment material 12, which embodiment is not pictured herein. If a separate motor is used, the separate motor may be electrically or otherwise powered. The mechanical energy from the separate motor may be used to turn the broadcaster 40, 50 in either the first or second embodiments. In an embodiment configured for use with liquid treatment material 12, the mechanical energy from the separate motor may be used to operate the pump that provides the motive force for liquid treatment material 12. In any embodiment employing a separate motor, the broadcaster actuator 28 may be comprised of a button or switch that energizes the separate motor rather than a lever as pictured herein for the first and second embodiments.

The optimal area of the material slots 30*a*, 66 in any embodiments disclosed herein will vary depending on the operator preferences, environmental conditions, amount of kinetic energy transferred from the snow removal machine 20 to the container 30, 60, and type of treatment material 12 used. It is contemplated that for relatively round, dry treatment material 12, the optimal area of the material slot 32 for the first and second embodiment may be between one-half and four square inches, although other areas may be used. It is further contemplated that for similar treatment material 12 used in the third embodiment, the optimal combined area of the material slots 61 may be between one and six square inches, although other areas may be used.

The material dispenser 10 and various elements thereof, including the container 30, 60, shoulder 60*a*, container lid 60*b*, slide gate 32, 66, broadcaster 40, 50 and various components thereof, actuation member 47 and various components thereof, slide gate control 42, 52, agitator 43, 53, broadcaster actuator 28, ratcheting mechanism, bidirectional actuating mechanism, return spring 44, 54, pawl spring 48*a*, slide gate return spring 64, deflector 36 and other components of the material dispenser 10 disclosed herein may be constructed of any materials know to those skilled in the art suitable for the specific application of the snow removal machine 20. Such materials include but are not limited to metal, steel, aluminum, wood, polymers, etc., and/or any combinations thereof.

The relative dimensions and orientations of the various elements are not limiting with regard to the scope of the present disclosure. Accordingly, alterations and variations may be made without departure from the spirit of the material dispenser 10. It should be noted that the material dispenser 10 is not limited to the specific embodiments pictured and described herein, but is intended to apply to all similar apparatuses that function to broadcast treatment material 12 from a snow removal machine 20 independently of whether the snow removal machine 20 is operating to engage precipitation. Modifications and alterations from the described embodiments will occur to those skilled in the art without departure from the spirit and scope of the material dispenser 10.

Furthermore, variations and modifications of the foregoing are within the scope of the material dispenser 10. It is understood that the material dispenser 10 as disclosed and defined herein extends to all alternative combinations of two or more of the individual features mentioned or evident from the text and/or drawings. All of these different combinations constitute various alternative aspects of the material dispenser 10. The embodiments described herein explain the best modes known for practicing the material dispenser 10 and will enable others skilled in the art to utilize the same. The claims are to be construed to include alternative embodiments to the extent permitted by the prior art.

The invention claimed is:

1. A method of dispensing a treatment material while using a snow removal machine, said method comprising the steps of:

a. affixing a material dispenser to a snow removal machine, wherein said material dispenser includes a container that generally has an opening, a material slot and a plurality of sides configured for material containment;

b. placing said treatment material in said container;

c. affixing a first end of a cable to a slide gate, wherein said slide gate is engaged with said container adjacent said material slot such that a portion of said slide gate is positioned over said material slot;

d. positioning a non-rotatable material director below said material slot, wherein said material director includes at least two portions, and wherein said at least two portions are angled downward and away from said material slot;

e. opening said slide gate by manipulating a second end of said cable; and f. allowing kinetic energy in the form of vibrations from the operation of said snow removal machine to cause said treatment material to exit said container through said material slot.

2. The method according to claim 1 wherein said material dispenser is further defined as comprising a container lid for engagement with said container opening.

3. The method according to claim 1 wherein said material dispenser is further defined as comprising a slide gate actuator, wherein said slide gate actuator is positioned remote from said container and affixed adjacent a handle of said snow removal machine, and wherein said second end of said cable is affixed to said slide gate actuator.

4. The method according to claim 2 wherein said material dispenser is further defined as comprising a slide gate actuator, wherein said slide gate actuator is positioned remote from said container and affixed adjacent a handle of said snow removal machine, and wherein said second end of said cable is affixed to said slide gate actuator.

5. The method according to claim 2 wherein said material dispenser is further defined as comprising a slide gate return spring, wherein said slide gate return spring biased said slide gate to a position wherein said slide gate completely covers said material slot.

6. The method according to claim 4 wherein said material dispenser is further defined as comprising a slide gate return spring, wherein said slide gate return spring biased said slide gate to a position wherein said slide gate completely covers said material slot.

7. A method of dispensing a treatment material while using a snow removal machine, said method comprising the steps of:

a. affixing a material dispenser to a snow removal machine, wherein said material dispenser includes a container that is generally tapered from the upper side thereof to the lower side thereof such that the cross-sectional area of said container decreases from the top to bottom thereof;
b. placing said treatment material in said container;
c. positioning a container lid on the top of said container;
d. affixing a first end of a cable to a slide gate, wherein said slide gate is engaged with said container adjacent a material slot such that a portion of said slide gate is positioned over said material slot;
e. positioning a non-rotatable material director below said material slot, wherein said material director includes at least two portions, and wherein said at least two portions are angled downward and away from said material slot;
f. opening said slide gate by manipulating a second end of said cable; and
g. allowing kinetic energy in the form of vibrations from the operation of said snow removal machine to cause said treatment material to exit said container through said material slot.

8. The method according to claim 7 wherein said material dispenser is further defined as comprising said material director positioned on the exterior of said material dispenser adjacent said material slot.

9. The method according to claim 8 wherein said material dispenser is further defined as comprising a slide gate actuator, wherein said slide gate actuator is positioned remote from said container and affixed adjacent a handle of said snow removal machine, and wherein said second end of said cable is affixed to said slide gate actuator.

10. The method according to claim 9 wherein said material dispenser is further defined as comprising a slide gate return spring, wherein said slide gate return spring biased said slide gate to a position wherein said slide gate completely covers said material slot.

11. A method of dispensing a treatment material while using a snow removal machine, said method comprising the steps of:

a. affixing a material dispenser to a snow removal machine, wherein said material dispenser includes a container that generally has an opening, a material slot and a plurality of sides configured for material containment;
b. placing said treatment material in said container;
c. affixing a first end of a cable to a slide gate, wherein said slide gate is engaged with said container adjacent said material slot such that a portion of said slide gate is positioned over said material slot;
d. positioning a non-rotatable material director below said material slot;
e. opening said slide gate by manipulating a second end of said cable; and
f. allowing kinetic energy in the form of vibrations from the operation of said snow removal machine to cause said treatment material to exit said container through said material slot such that said treatment material contacts said non-rotatable material director.

* * * * *